US005641078A

United States Patent [19]

Kaufmann

[11] Patent Number: 5,641,078

[45] Date of Patent: Jun. 24, 1997

[54] DEVICE FOR FILLING WRITING, DRAWING, PRINTING, OR PAINTING UTENSILS

[75] Inventor: Rainer Kaufmann, Delmenhorst, Germany

[73] Assignee: Dataprint R. Kaufmann KG (GmbH & Co.), Delmenhorst, Germany

[21] Appl. No.: 403,843

[22] PCT Filed: Jul. 11, 1994

[86] PCT No.: PCT/DE94/00811

§ 371 Date: Mar. 13, 1995

§ 102(e) Date: Mar. 13, 1995

[87] PCT Pub. No.: WO95/02514

PCT Pub. Date: Jan. 26, 1995

[30] Foreign Application Priority Data

Jul. 13, 1993 [JP] Japan ..... 43 23 458.5

[51] Int. Cl.[6] ..... A47F 7/00; B43M 17/00

[52] U.S. Cl. ..... 211/69.4; 222/576; 15/257.075

[58] Field of Search ..... 211/69.4, 69.1, 211/69.2, 69.3; 222/576, 581, 585, 586, 588, 589; 15/257.07, 257.072, 257.073, 257.074, 257.075, 257.076

[56] References Cited

U.S. PATENT DOCUMENTS

| | | | |
|---|---|---|---|
| 678,315 | 7/1901 | Holden | 15/257.07 |
| 880,973 | 3/1908 | Clarke | 222/576 |
| 993,347 | 3/1911 | Cogger | 15/257.075 |
| 1,034,295 | 7/1912 | Pharr | 15/257.075 |
| 1,916,186 | 6/1933 | Meunier | 222/581 |
| 2,227,091 | 12/1940 | Kendrick | 222/581 |
| 2,233,942 | 3/1941 | Frey | 120/4 |
| 2,629,359 | 2/1953 | Rosenthal | 118/268 |
| 2,708,904 | 5/1955 | Rhoades | 211/69.4 X |
| 2,889,810 | 6/1959 | Randolph | 120/57 |
| 3,035,542 | 12/1962 | Rosenthal | 118/268 |

FOREIGN PATENT DOCUMENTS

| | | | |
|---|---|---|---|
| 0166552 | 1/1986 | European Pat. Off. . | |
| 978832 | 11/1950 | France . | |
| 1330188 | 6/1963 | France . | |
| 296306 | 1/1917 | Germany | 222/576 |
| 608457 | 9/1948 | United Kingdom . | |
| 9220531 | 11/1992 | WIPO . | |

*Primary Examiner*—Ramon O. Ramirez
*Assistant Examiner*—Sandra S. Snapp
*Attorney, Agent, or Firm*—Robert W. Becker & Associates

[57] ABSTRACT

A device for filling a writing utensil with a writing liquid has a container having an interior for receiving the writing liquid and a container opening for refilling the interior with the writing liquid. A receiving member is inserted into the container opening so as to provide a tight seal between the receiving member and the container opening. An air inlet connection connects the interior to the atmosphere. A capillary conveying connection, including a first and a second end, is provided for conveying the liquid from the interior to a writing utensil, wherein said first end opens into the receiving member for contacting a writing tip of a writing utensil to be inserted into the receiving member. A seal, connected to the receiving member, seals the writing utensil inserted into the receiving member toward the atmosphere.

16 Claims, 5 Drawing Sheets

DEVICE FOR FILLING WRITING, DRAWING, PRINTING, OR PAINTING UTENSILS

BACKGROUND OF THE INVENTION

The invention relates to a device for filling of writing, drawing, printing, or painting utensils (writing utensils) which are provided with a writing, drawing, printing, or painting tip (writing tip) with writing, drawing, printing, or painting liquid (writing liquid), comprising a container for receiving the writing liquid, the interior of which is connected to the atmosphere, as well as having a capillary liquid conveying connection through which the transport of the writing liquid from the interior of the container to the writing utensil or to a writing liquid reservoir of a writing utensil is carried out, wherein a device for receiving the writing utensil or the writing liquid reservoir is received in a sealing manner within the container opening, wherein one side of the capillary liquid conveying connection opens into the device and contacts the writing tip of the writing utensil or an inlet opening for writing liquid of the writing liquid reservoir.

A device of such kind is known (WO 92/20531). Writing, drawing, printing, and painting utensils and/or writing liquid reservoirs of such utensils, in the following referred to as writing utensils, are known and used in a plurality of embodiments. With writing utensils of this kind the writing liquid in most cases is stored in a capillary reservoir belonging to the writing utensil that, however, for so-called disposable writing utensils is not designed to be refilled with writing liquid, even though this refilling is in principle possible for most of such disposable writing utensils.

With the known device it is now possible to simply insert, respectively, position writing utensils to be refilled or a writing liquid reservoir into the device and, subsequently, to allow the refilling process for writing utensils with a capillary reservoir to take place completely automatically or as well to allow writing utensils that are provided with a conventional piston mechanism to cover the opening of the liquid conveying connection so that, by displacing the piston of the writing utensil, the writing liquid can be sucked from the container; this applies as well to writing liquid reservoirs designed as a cartridge which can then be inserted as a cartridge into writing utensils.

The known device has proven to be very well suited and has found great acceptance with the consumers.

It has been found that, for example, problems occur occasionally with writing utensils like the above described piston fountain-pen or the ones with the above described piston cartridges on refilling with the known device, namely of the kind that the reservoir of the piston fountain-pen, respectively, of the piston cartridge, could not be filled up sufficiently in all cases.

Therefore, it is an object of the present invention to develop a device of the known kind to the effect that with this device also a refilling of piston fountain-pens, piston cartridges, and other writing utensils of the like is possible, wherein the refilling process has to be carried out such that the writing liquid reservoir of the piston fountain-pen, respectively, of the piston cartridge or the like can be refilled completely, without causing other writing utensils to be refilled of the kind mentioned in the introductory part to suffer with respect to their refillability with writing liquid. Finally, the manufacturing process of the device should be simple and cost-efficient, whereby disposable writing utensils which are, in general, not designed for refilling can be refilled with the device, with which the writing utensil, or areas thereof, are not soiled during refilling with the writing liquid and which is leak-proof even when the device is positioned with its opening pointing downward.

SUMMARY OF THE INVENTION

The object is solved according to the present invention by providing a sealing means that is arranged within the receiving member and that seals the end of the writing utensil or of the writing liquid reservoir inserted into the receiving member toward the atmosphere.

The device for filling a writing utensil with a writing liquid according to the present invention is primarily characterized by:

a container having an interior for receiving the writing liquid and a container opening for refilling the interior with the writing liquid;

a receiving member inserted into the container opening so as to provide a tight seal between the receiving member and the container opening;

an air inlet connection connecting the interior to the atmosphere;

a capillary conveying connection, comprising a first and a second end, for conveying the liquid from the interior to a writing utensil, wherein the first end opens into the receiving member for contacting a writing tip of a writing utensil to be inserted into the receiving member;

a sealing means, connected to the receiving member, for sealing a writing utensil inserted into the receiving member toward the atmosphere.

Preferably, the sealing means is embodied such that it rest elastically on the writing utensil inserted into the receiving member.

The sealing means is preferably a ring member extending along the inner periphery of the receiving member.

Expediently, the sealing means has in cross-section a lip-shaped profile or, in the alternative, has a circular cross-section (O-ring).

The sealing means is advantageously arranged such in the receiving member that the writing utensil, when inserted into the receiving member, rests with a leading end face on the sealing means.

Preferably, the receiving member comprises an integral projection and the writing utensil has a writing tip that is provided with a recess. The projection sealingly engages the recess, when the writing utensil is inserted into the receiving member.

The device preferably further comprises a snap closure for pressing the writing utensil against the sealing means.

In another embodiment of the present invention, the device further comprises a screw cap closure for pressing the writing utensil against the sealing means.

The receiving member comprises a circular groove in which the sealing means is received.

The sealing means is arranged at an end of the receiving member proximal to the interior of the container.

At least the first end of the capillary conveying connection is elastic for allowing at least a partial penetration of the writing tip of the writing utensil.

The receiving member comprises a closure means for being sealingly received in the container opening.

The sealing means seals off the first end of the capillary conveying connection against the atmosphere when the writing utensil is removed from the receiving member.

The sealing means comprises a disc made of elastically deformable material. The disc has in a central area at least one incision for allowing penetration thereof by the writing utensil.

The air inlet connection opens to the atmosphere exterior of the sealing means.

The advantage of the inventive device lies essentially in the fact that the writing utensil now is inserted into the receiving member through a sealing means which ensures that a vacuum for the suction process of a piston fountain-pen, respectively, of the piston of a piston cartridge can be created. Thus, it is ensured in any case that the suction, respectively, refilling process can be carried out properly and completely, i.e. that the reservoir of the piston fountain-pen, of the piston cartridge etc. can actually be refilled completely. A further essential advantage of the inventive device lies in the fact that by providing the sealing means within the receiving member the refilling of other writing, drawing, printing, or painting utensils that are provided with capillary reservoirs for the writing liquid, is, generally, neither hindered nor restricted, i.e. that these writing utensils when being used in connection with the inventive device are refilled automatically as it is described in detail in the aforementioned prior art. For these writing utensils the inventive device does not only provide the possibility that these writing utensils can be refilled automatically with the device according to the invention, but the sealing means within the receiving member can also be useful with these writing utensils that can be refilled by capillary action, namely in so far as during the refilling process a drying out of the writing liquid at the location of contact between the writing tip and the capillary conveying connection is prevented.

With an advantageous embodiment of the invention the sealing means is designed such that it rests snuggly and elastically against the writing utensil or the writing liquid reservoir. On the one hand, the sealing action thus is sufficiently great so that a sufficient vacuum can be created for the refilling process; on the other hand, it must be provided that the writing utensil can be inserted into the receiving member and removed therefrom with an appropriately adjusted force such that the writing tip can elastically rest at the contact location of the capillary conveying connection.

In principle, the sealing means can advantageously be designed as a ring member that is circularly arranged within the receiving member and thereby be provided with any appropriate cross-section.

However, in order to satisfy fully the aforementioned requirements for elastically receiving the writing utensil, on the one hand, and an elastic resting of the writing tip against the capillary conveying connection, on the other hand, the sealing means is advantageously in its cross-section embodied as a lip-shaped profile, whereby such a profile allows an easy inserting of the writing utensil and, on the other hand, still guarantees a good sealing action toward the atmosphere.

For many purposes, in particular if only a certain kind of writing utensils is to be refilled by the device, i.e. no writing utensil of differing constructions have to be received in an equally well sealing manner, it is advantageous to provide the sealing means in its cross-section with a circular profile (O-ring).

Preferably, the sealing means is arranged within the receiving member such that the writing utensil or the writing liquid reservoir, when inserted, rest within the receiving member with their end face against the sealing means. Often, there is still writing liquid contained inside the writing utensil which is pressed into the container when the piston of the writing utensil is twisted forward and thereby could reach the area of the sealing means, disadvantageously resulting in the writing utensil, after refilling, having writing liquid remainders at its housing with which the user disadvantageously comes into contact with his fingers. This embodiment of the device prevents such a soiling with writing liquid.

With a further advantageous embodiment of the device a projection is provided as an integral part of the receiving member wherein the projection engages detachably sealingly a recess which is designed round the writing tip of the writing utensil.

It is also advantageously possible that the writing utensil or the writing liquid reservoir is pressed against the sealing means by a snap closure or a screw cap. Such a design of the writing utensil or the writing liquid reservoir in connection with the device has the advantage that, on the one hand, the writing utensil is not wetted in the finger contacting area with writing liquid, and, on the other hand, writing utensils with different front portions can be used as long as the thread matches. The same result could also be achieved by a snap closure at the writing utensil in connection with the device.

Essentially, the sealing means that is arranged within the receiving member can be attached to the receiving member in any appropriate way. However, it has proven to be advantageous to insert the sealing means into a circular groove formed within the receiving member so that no separate connection is required; the sealing means can be simply replaced if necessary in case of fatigue of the sealing means by taking the fatigued sealing means out of the groove and replacing it with a new one.

In principle, the sealing medium can be arranged at any desired location within the interior of the receiving member, even as a function of the constructive design of the writing utensil that is to be filled by the device. The embodiment that is the most appropriate for many cases is advantageously designed such that the sealing means is arranged at the end of the receiving member facing the container.

Particularly, if the writing utensil to be refilled by the device is a conventional piston fountain-pen with a conventional writing tip, it is advantageous to design at least the respective end of the liquid conveying connection which faces the receiving member elastically such that the possibility is given that the writing tip can at least partly be inserted elastically into the liquid conveying connection. The material that forms the liquid conveying connection has to be embodied elastically at least at this portion.

In order to ensure finally that the container does not leak, it is advantageous that the receiving member provides means for sealingly receiving within the opening of the container. The member for sealingly receiving can, for example, be a snap closure or a screw thread between the container and the receiving member.

The sealing means can be designed such that it at least substantially seals the capillary liquid conveying connection toward the atmosphere, when the device for receiving a writing utensil is empty. Thus, a drying out of the writing liquid is prevented.

Advantageously, the sealing medium in the latter embodiment is designed as a disc made of an elastic, flexible material that provides in its central area at least one incision through which the writing utensil, respectively a writing liquid reservoir can be inserted.

Preferably the interior of the container is connected to the atmosphere via a connection that ends outward of the sealing medium. This connection is at least required in those cases in which air that on refilling of the utensil is displaced by the refilled liquid is not introduced into the interior of the container. Otherwise a vacuum would be created within the interior of the container and hinder the transport of liquid through the liquid conveying connection. Such a connection toward the atmosphere is particularly expedient when a piston fountain-pen is to be filled.

BRIEF DESCRIPTION OF THE DRAWINGS

The present invention is now described with the aid of several embodiments and by referring to the following schematical drawings. It is illustrated in.

DESCRIPTION OF PREFERRED EMBODIMENTS

Figure 1:
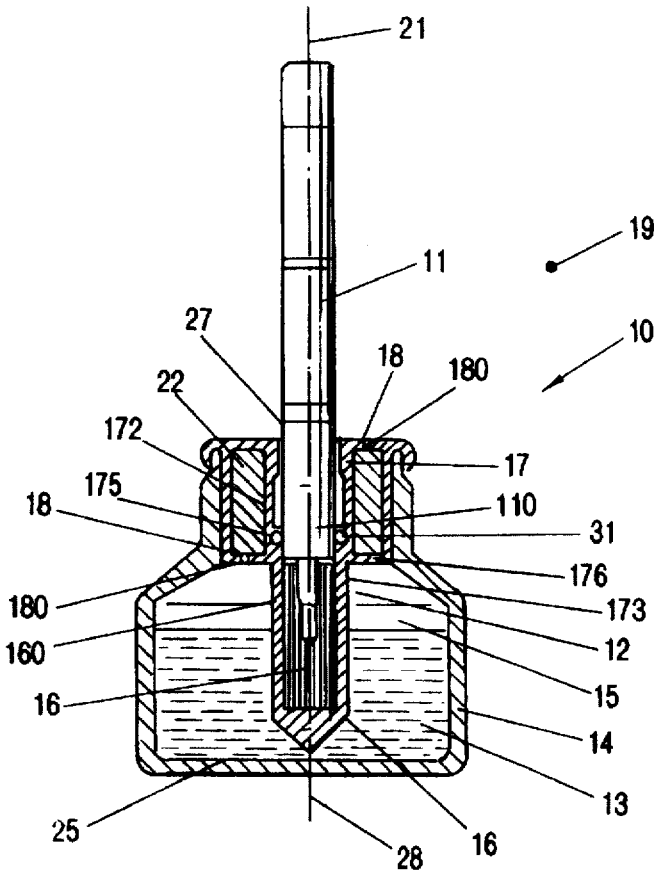
FIG. 1 a sectional side view of a device with a writing utensil inserted into the receiving member of the device, in the shape of a conventional piston fountain-pen FIG. 2 an illustration according to FIG. 1, but with a writing utensil that has a fiber tip and a capillary reservoir tubular writing utensil, FIG. 3 an illustration like FIG. 1, however, with a piston cartridge that serves as a refillable writing fluid reservoir for writing utensils, FIG. 4 an illustration like FIG. 1, in which, however, the writing utensil that is to be filled rests, with its end that is facing away from its writing tip, at the location of contact with the capillary conveying connection, FIG. 5 a cross-section of a device for illustrating a preferred embodiment of the lower end of the capillary conveying connection, FIG. 6 an embodiment of the receiving member with a circular ring slot that faces the interior of the container, FIG. 7 an embodiment of the receiving member with a writing utensil according to FIG. 1, whereby, however, the sealing means contacts the writing utensil with its end face, FIG. 8 an embodiment of the receiving member with a writing utensil according to FIG. 1, in which the sealing means is provided with a projection that is formed integrally with the receiving member, and with a recess, whereby the projection engages the recess that is formed round the writing tip of the writing utensil.
Figure 2:
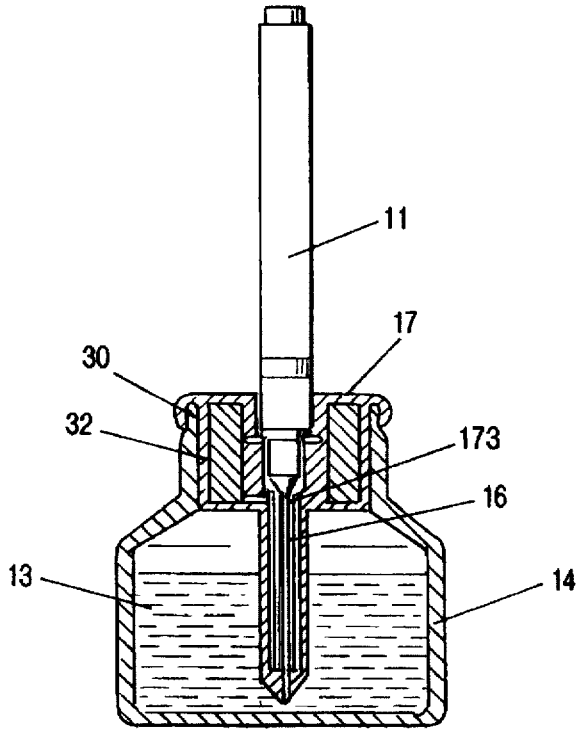

The device 10 is comprised substantially of a container which in the embodiments illustrated in the drawings is essentially bottle-shaped. It should be noted, however, that the container 14, in principle, may have any desired, appropriate shape with any desired, appropriate cross-section. The device 10 further comprises a receiving member 17 which, in the embodiment illustrated in the drawings, has a substantially cylindrical design with a substantially circular cross-section and can be inserted air- and liquid-tightly into a container refill opening 30 that is provided at the upper end of the container 14.

The receiving member 17 can be provided with a closure means 32 for being received in a sealing manner within the container opening, i.e., so as to provide a tight seal between the receiving member and the container opening. These closure means can be designed, for example, as a snap closure or as threaded elements (screw cap closure) formed at the container 14 as well as at the receiving member 17.

The container axis 21 and the axis of the receiving member 28, in the illustrated embodiment of the device 10, are axially aligned with each other which, however, is not required in all cases.

A substantially cylindrically shaped capillary conveying connection 16 is arranged axially relative to the receiving member 17 and extends from there into the interior 15 of the container. The capillary conveying connection may be formed as a tubular capillary or may be made out of any appropriate porous material, for example, materials that are used for tips and reservoirs of conventional writing utensils 11. The upper end 160 of the capillary liquid conveying connection 16 can project into the interior 172 of the receiving member 17 up to a certain extent, compare FIG. 4. The other end 161 of the capillary liquid conveying connection 16 extends into the interior 15 of the container to the area of the container bottom 25.

Within the receiving member 17 an air inlet connection 18 is provided which has an opening 180 at the inner surface of the container and an opening 180 toward the atmosphere 19. The hollow interior 177 which thus provides two openings 180 is filled with a capillary means 22.

Within the receiving member 17 a sealing means 31 is arranged at the end 176 of the receiving member 17 facing the container With the sealing means, the end of the writing utensil 11 or of the writing liquid reservoir to be inserted into the receiving member 17 can be sealed toward the atmosphere 19. The sealing means is embodied such that it can elastically rest on the lower end 110 of the writing utensil 11 or of the writing liquid reservoir. The sealing means 31 is received in a circular groove 175 that is formed within the receiving member 17. The sealing means 31 can, for example, be designed as a ring member with a lip-shaped profile in cross-section, or with a circular profile in cross-section, i.e., in the shape of an O-ring. Basically, however, any appropriate cross-sectional shape of the sealing medium 31 is possible.

Figure 7:
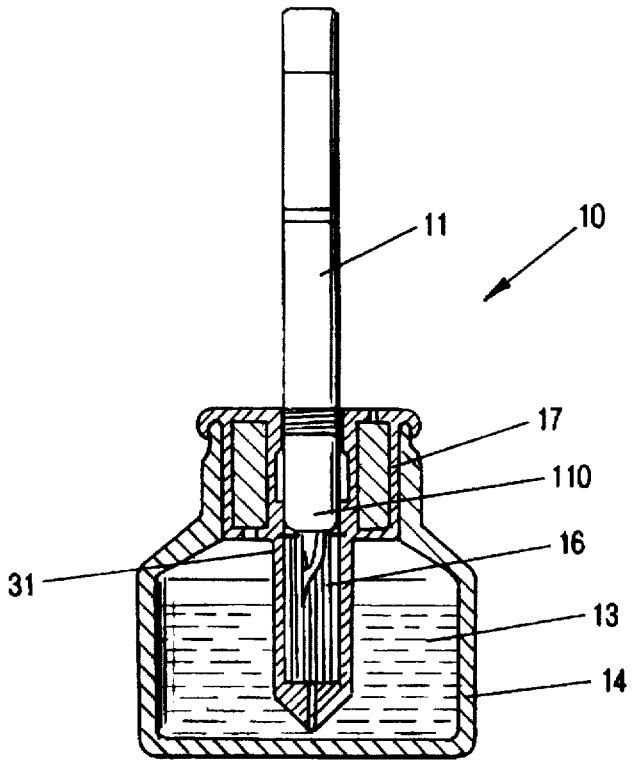
Figure 8:
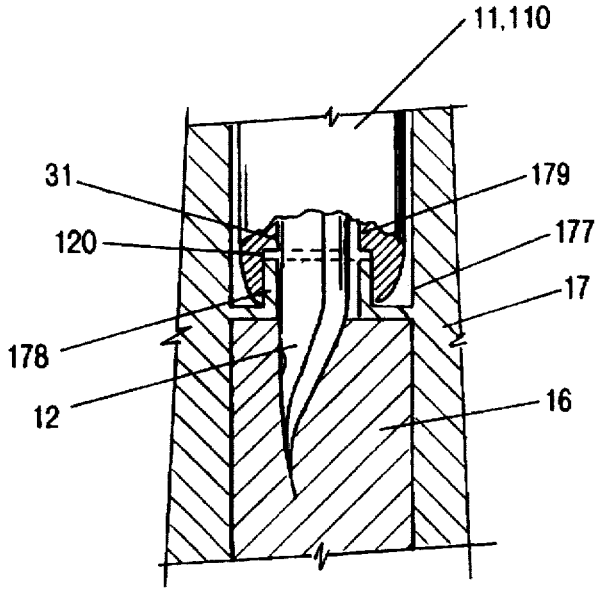

In the embodiments of the device 10 that are illustrated in FIGS. 7 and 8 the sealing means 31 is arranged at the end of the hollow interior 177 of the receiving member 17, facing the container. The writing utensil 11, therefore, rests on the sealing means 31 with its end face when it is inserted. Particularly, in the embodiment of the device 10 that is illustrated in FIG. 8 a projection 178 is provided that is formed on the receiving member 17 and which projects, respectively, extends into the hollow interior 177 of the receiving member 17. At the end face 179 of the projection 178 the sealing means 31 can be provided. The writing utensil 11 has a recess 120 formed round the writing tip 12 with which the projection 178 with the sealing means 31 comes into contact in the inserted state, resting in a sealing manner on the end face of the recess of the writing utensil 11. The recess 120, however, can also be dimensioned such that the projection 178 and the recess 120 form a fitting so that this fitting is the actual sealing means 31 without needing a separate ring made of elastic material or the like.

It can be stated that in general tube-shaped, correspondingly fitted connections (recess 120, projection 178) have the advantage that they can be realized without separate sealing materials.

When filling the device 10 itself, the receiving member 17 is first removed from the container refill opening 30 which it closes hermetically, and the container 14 is filled with writing liquid 13. For receiving so as to seal toward the atmosphere 19 the receiving member 17 within the container, the receiving member 17 has means for sealingly receiving. This means 32 for sealingly receiving can consist, for example, of a thread that is formed at the receiving member 17 and that engages a thread that is formed correspondingly in the container opening. However, the means 32 can, for example, also consist in a snap closure, as is illustrated in FIGS. 1 to 4.

The capillary conveying connection 16 which is immersed in the interior 15 of the container, respectively, in the writing liquid 13 almost contacts with its lower end 161 the container bottom 25. Due to the capillarity of the capillary liquid conveying connection 16 the writing liquid is transported to the upper end 160 of the capillary liquid conveying connection 16.

For filling a writing utensil, the utensil is inserted into the receiving opening 27 of the receiving member 17, against the low resistance that the sealing medium 31 exerts on the writing utensil 11 as soon as the writing utensil 11 contacts the sealing medium 31. The reacting force that the elastic sealing medium 31 exerts can be overcome by a slightly increased pressure such that the writing utensil 11 with its writing tip 12 contacts the upper end 160 of the capillary liquid conveying connection, or, alternatively, if the writing utensil 11 is formed as a conventional piston fountain-pen with a writing tip, at least partly penetrates the upper end 160 of the liquid conveying connection 16 which here is formed at least partly elastically. The writing liquid 13 thus flows, conveyed via the capillary liquid conveying connection 16, through the writing tip 12 into the reservoir contained in the writing utensil when the filling piston of the piston fountain-pen is moved in a manner that is known per se. The sealing means 31 ensures that the vacuum which is required for this process can build up in the space between the sealing means 31 and the capillary liquid conveying connection 16.

With writing utensils 11 that have a capillary reservoir the writing liquid 13 overcomes without problems the transition of the high capillarity of the writing tip 12 of the writing utensil 11 to be refilled into the lower capillarity of the capillary reservoir of the writing utensil because, independent of capillary discontinuities, the writing liquid 13 rises as high as the capillary rise allows.

When the writing utensil 11 after a certain time has been filled automatically with writing liquid 13, it can be easily removed from the receiving member 17, namely by a slightly increased force in the removing direction for overcoming the force that is exerted on the writing utensil 11 by the sealing means 31. The writing utensil 11 may also, in principle, always remain there, for example, with the device acting as an appropriate stand.

Figure 3:
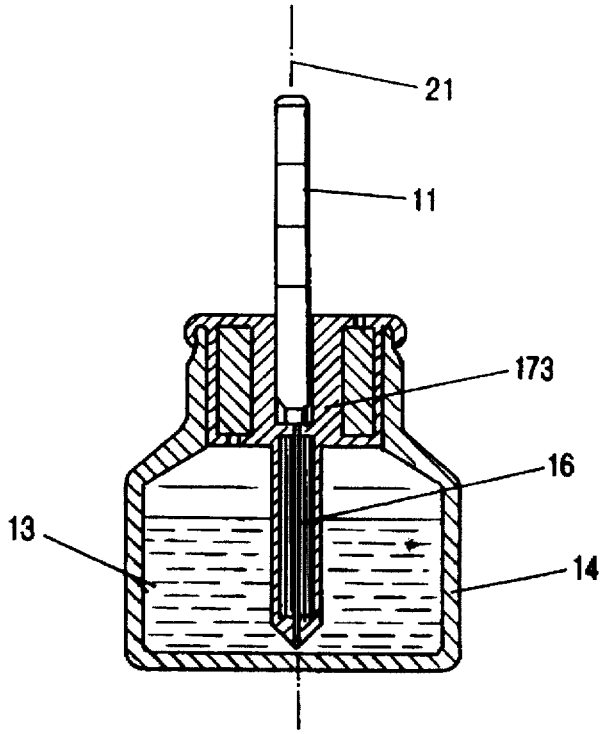
Figure 4:
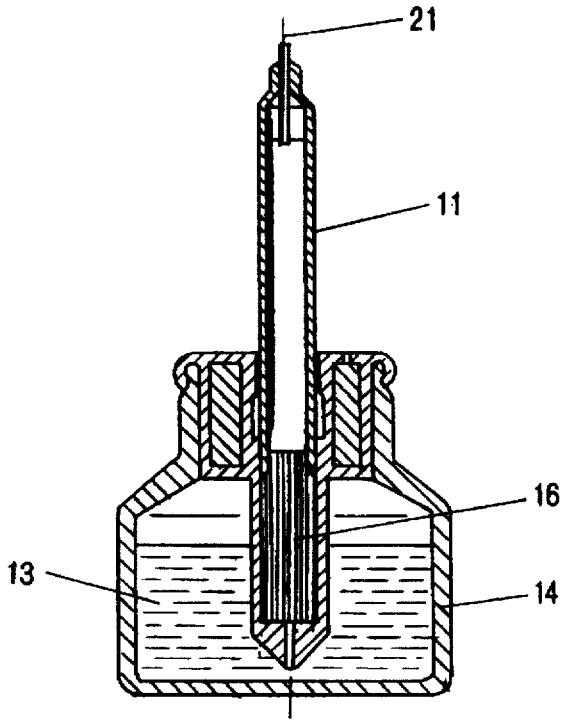

FIGS. 3 and 4 illustrate that instead of filling a writing utensil via the writing tip 12 there is also the option to fill the writing liquid reservoir of the writing utensil 11 directly, compare FIG. 3, if it is formed either detachably as a piston cartridge or the like, or if, for example, a place of attachment for refilling the reservoir is provided at the back side of the writing utensil 11, compare FIG. 4.

Figure 5:
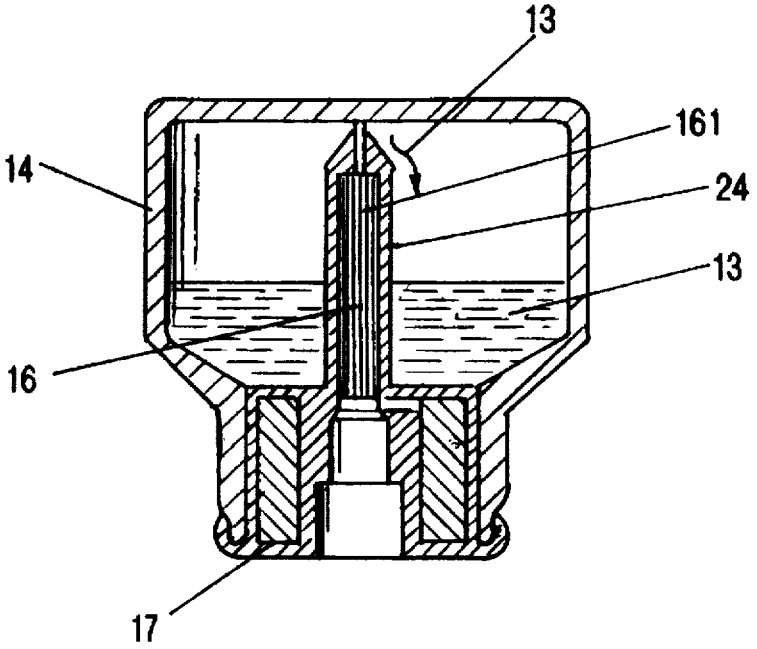

The position of the container 14 which is illustrated in FIG. 1 shows the upright position of the device 10 placed on a surface that is not illustrated here. In the embodiments of the device 10, which are illustrated in the Figures, the liquid conveying connection 16 is provided with a mantle 24. Writing liquid 13 adhering to the outside of the mantle 24 cannot leak from the liquid conveying connection 16 via its end 160, even when the container is tilted about 180° from the position illustrated in FIG. 1 to the position illustrated in FIG. 5. The embodiment of the device 10 that is illustrated in FIG. 5 in which the lower end 161 of the liquid conveying connection, respectively, the mantle 24 is formed conically, provides the possibility that remainders of writing liquid 13, that often remain between the liquid conveying connection 16 and the container bottom 25 when the container 14 is tilted, flow into the interior of the container; in the case of a non-conical shape, these remainders would slowly permeate the liquid conveying connection 16, and writing liquid 13 would leak out of the device 10.

Figure 6:
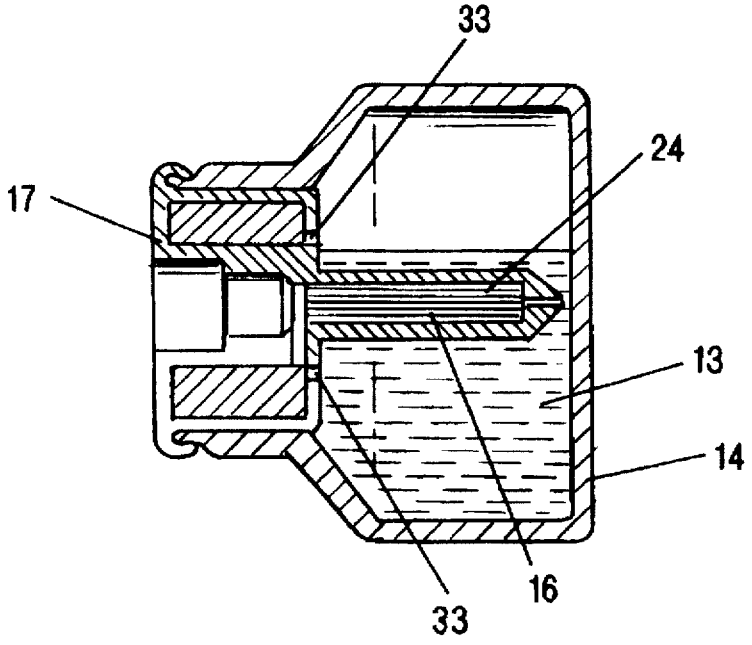

The embodiment of the device 10, illustrated in FIG. 6, even provides increased safety against writing liquid 13 penetrating the member 16 unintentionally. However, if writing liquid 13 were located below the air inlet connection 18 but still above the liquid conveying connection 16, the writing liquid 13 would simply penetrate the liquid conveying connection in the case of a horizontal position of the device 10. In order to prevent this, a ring slot 33 that acts as an air inlet opening 180 is provided which seals the air inlet opening 180 when the writing liquid 13 fills the space of the ring slot 33 due to its capillarity. Basically, the same effect can be achieved by means of a single opening which is connected to an annular capillary rest.

Figure 9A:
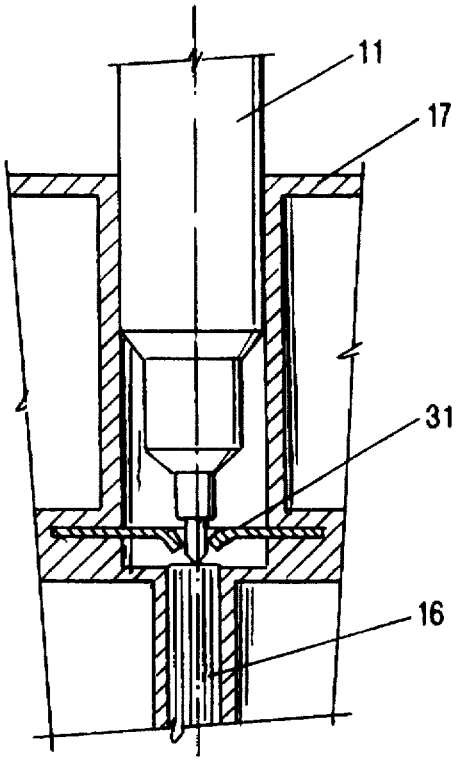
FIGS. 9*a*, 9*b*, and 9*c* are different views of an embodiment of the receiving member with a sealing means which normally seals the receiving member toward the liquid conveying connection and comes into a sealing contact with an object that is to be refilled when it is inserted.
Figure 9B:
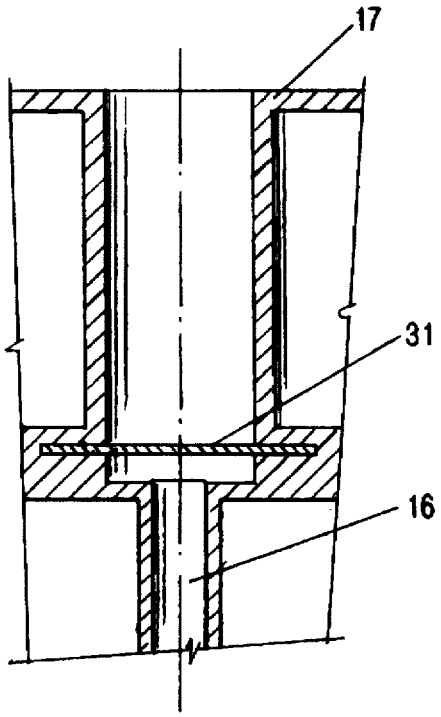
Figure 9C:
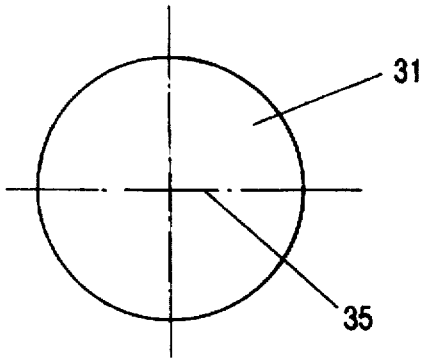

FIG. 9 illustrates a further embodiment of the inventive device 10 in part sectional views. In this embodiment the sealing means is designed as a disc 31 made of an elastic, flexible material, for example, an elastomer, and is mounted in the receiving member 17 above the capillary conveying connection According to FIG. 9*c*) illustrating a plan view, the disc 31 is provided with two crossed incisions 35 at its center. It is understood that also only a single incision 35 or several incisions 35 can be provided.

If the receiving device is empty, according to FIG. 9*b*), the disc 31 is planar and closed so that the upper free end face, according to FIG. 9, of the liquid conveying connection 16 is sealed off toward the outer atmosphere by the disc 31 and thus is protected against drying of the writing liquid.

On inserting a writing utensil 11 into the receiving member 17 according to FIG. 9*a*), the writing tip of a felt-tip pen, in the illustrated example, penetrates the disc 31, whereby its incisions 35 open and come into a sealing abutment at the tip, respectively, in the illustrated example, at a recess at which the writing tip has a transition into the body of the felt-tip pen.

The present invention is, of course, in no way restricted to the specific disclosure of the specification and drawings, but also encompasses any modifications within the scope of the appended claims.

What I claim is:

1. A device for filling a writing utensil with a writing liquid, said device comprising:

a container having an interior for receiving the writing liquid and a container opening for refilling said interior with the writing liquid;

a receiving member inserted into said container opening so as to provide a tight seal between said receiving member and said container opening;

an air inlet connection connecting said interior to the atmosphere;

a capillary conveying connection, comprising a first and a second end, for conveying the liquid from said interior to a writing utensil, wherein said first end opens into said receiving member for contacting a writing tip of a writing utensil to be inserted into said receiving member;

a sealing means, connected to said receiving member, for sealing an end of a writing utensil inserted into said receiving member toward the atmosphere.

2. A device according to claim 1, wherein said sealing means is embodied such that it rest elastically on the writing utensil inserted into said receiving member.

3. A device according to claim 1, wherein said sealing means is a ring member extending along the inner periphery of said receiving member.

4. A device according to claim 3, wherein said sealing means has in cross-section a lip-shaped profile.

5. A device according to claim 3, wherein said sealing means has a circular cross-section.

6. A device according to claim 1, wherein said sealing means is arranged such in said receiving member that a writing utensil, when inserted into said receiving member, rests with a leading end face on said sealing means.

7. A device according to claim 6, wherein:

said receiving member comprises an integral projection that sealingly engages a recess at a writing tip of a writing utensil, when inserted into said receiving chamber.

8. A device according to claim 1, further comprising a snap closure for pressing the writing utensil against said sealing means.

9. A device according to claim 1, further comprising a screw cap closure for pressing the writing utensil against said sealing means.

10. A device according to claim 1, wherein said receiving member comprises a circular groove in which said sealing means is received.

11. A device according to claim 1, wherein said sealing means is arranged at an end of said receiving member proximal to said interior of said container.

12. A device according to claim 1, wherein at least said first end of said capillary conveying connection is elastic for allowing at least a partial penetration of the writing tip of the writing utensil.

13. A device according to claim 1, wherein said receiving member comprises a closure means for being sealingly received in said container opening.

14. A device according to claim 1, wherein said sealing means seals off said first end of said capillary conveying connection against the atmosphere when the writing utensil is removed from said receiving member.

15. A device according to claim 14, wherein said sealing means comprises a disc made of elastically deformable material, said disc having in a central area at least one incision for allowing penetration thereof by the writing utensil.

16. A device according to claim 1, wherein said air inlet connection opens to the atmosphere exterior of said sealing means.

* * * * *

UNITED STATES PATENT AND TRADEMARK OFFICE

CERTIFICATE OF CORRECTION

PATENT NO. : 5,641,078

DATED : June 24, 1997

INVENTOR(S) : Kaufmann

It is certified that error appears in the above-indentified patent and that said Letters Patent is hereby corrected as shown below:

On the title page, item [30] should read:

[30] Foreign Application Priority Data
Jul. 13, 1993 [DE] Germany ..... 43 23 458.5

Signed and Sealed this

Sixteenth Day of September, 1997

*Attest:*

Bruce Lehman

BRUCE LEHMAN

*Attesting Officer*

*Commissioner of Patents and Trademarks*